US007439921B2

(12) United States Patent
Hu et al.

(10) Patent No.: US 7,439,921 B2
(45) Date of Patent: Oct. 21, 2008

(54) CHIP ANTENNA APPARATUS FOR RECEIVING GLOBAL POSITIONING SYSTEM SIGNALS

(75) Inventors: Chuan-Lin Hu, Sijhih (TW); Yu-Wei Chen, Sijhih (TW); Chang-Lun Liao, Sijhih (TW); Shun-Tian Lin, Taipei (TW); Chang-Fa Yang, Taipei (TW); Yen-Ming Chen, Taipei (TW); Chao-Wei Wang, Taipei (TW)

(73) Assignee: Chant Sincere Co., Ltd., Hsi Chih, Taipei Hsien (TW)

( * ) Notice: Subject to any disclaimer, the term of this patent is extended or adjusted under 35 U.S.C. 154(b) by 0 days.

(21) Appl. No.: 11/564,067

(22) Filed: Nov. 28, 2006

(65) Prior Publication Data

US 2007/0247370 A1 Oct. 25, 2007

(30) Foreign Application Priority Data

Apr. 20, 2006 (TW) ..... 95114172 A

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 6,140,968 | A * | 10/2000 | Kawahata et al. | 343/700 MS |
| 6,700,543 | B2 * | 3/2004 | Konishi et al. | 343/700 MS |
| 6,759,990 | B2 * | 7/2004 | Rossman | 343/700 MS |
| 6,903,692 | B2 * | 6/2005 | Kivekas et al. | 343/702 |
| 7,061,434 | B2 * | 6/2006 | Aoyama et al. | 343/702 |
| 2006/0290570 | A1 * | 12/2006 | Hilgers | 343/700 MS |

* cited by examiner

*Primary Examiner*—Hoang V Nguyen
(74) *Attorney, Agent, or Firm*—Thomas, Kayden, Horstemeyer & Risley

(57) ABSTRACT

A chip antenna apparatus for receiving global positioning system signals, includes a L-shaped ground area and an omni-directional chip antenna. The L-shaped ground area is disposed on a circuit board. The omni-directional chip antenna is disposed in a gap of the L-shaped ground area on the circuit board and electrically connected to the L-shaped ground area.

3 Claims, 14 Drawing Sheets

CHIP ANTENNA APPARATUS FOR RECEIVING GLOBAL POSITIONING SYSTEM SIGNALS

RELATED APPLICATIONS

The present application is based on, and claims priority from, Taiwan Application Serial Number 95114172, filed Apr. 20, 2006, the disclosure of which is hereby incorporated by reference herein in its entirety.

BACKGROUND

1. Field of Invention

The present invention relates to a chip antenna apparatus for receiving global positioning system signals. More particularly, the present invention relates to a chip antenna apparatus with an L-shaped ground area for receiving global positioning system signals.

2. Description of Related Art

The rapid growth in wireless communication, for example, cell phone, computer and Wi-Fi network, makes wireless signal transmission possible. One example of wireless transmission applications is that Global Positioning System (GPS) has been integrated into cell phone to further achieve practical use of cell phones.

The frequency bands for Mobile Communications (GSM) are 900 MHz and 1800 MHz and are different from the GPS frequency band which is 1575 MHz, so different antennas are required for foregoing different functionalities. Further, GPS signal is a circular polarization signal which is different from the linear signal for GSM. Therefore, there is a need for cell phone to have a GPS antenna which is connected to the GPS receiver circuit integrated in the cell phone.

Conventional GPS uses a patch antenna to receive the circular polarization signal. The patch antenna is a directional antenna, capable of receiving the wireless signal. However, if patch antenna is used in order to integrate GPS functionality into cell phone, the patch antenna only receives satellite signal from specific directions. This affects reception of a moving cell phone (without fixed position and direction), so the positioning problem will be caused by interrupted satellite signals.

For the foregoing reasons, there is a need to overcome the weak signal and inaccurate positioning problem when integrating GPS with conventional cell phone which only receives signal from specific directions.

SUMMARY

It is therefore an objective of the present invention to provide a chip antenna apparatus for receiving GPS signals. The chip antenna apparatus for receiving GPS signals uses an omni-directional chip antenna to receive satellite signal from any direction. Further, the accuracy of GPS positioning is further improved because GPS signal can be strengthened by a coupling effect between the omni-directional chip antenna and an L-shaped ground area.

In accordance with the foregoing and other objectives of the present invention, the chip antenna apparatus for receiving GPS signals includes an L-shaped ground area and an omni-directional chip antenna. The L-shaped ground area is disposed on a circuit board. The omni-directional chip antenna is disposed in a gap of the L-shaped ground area on the circuit board and electrically connected to the L-shaped ground area.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
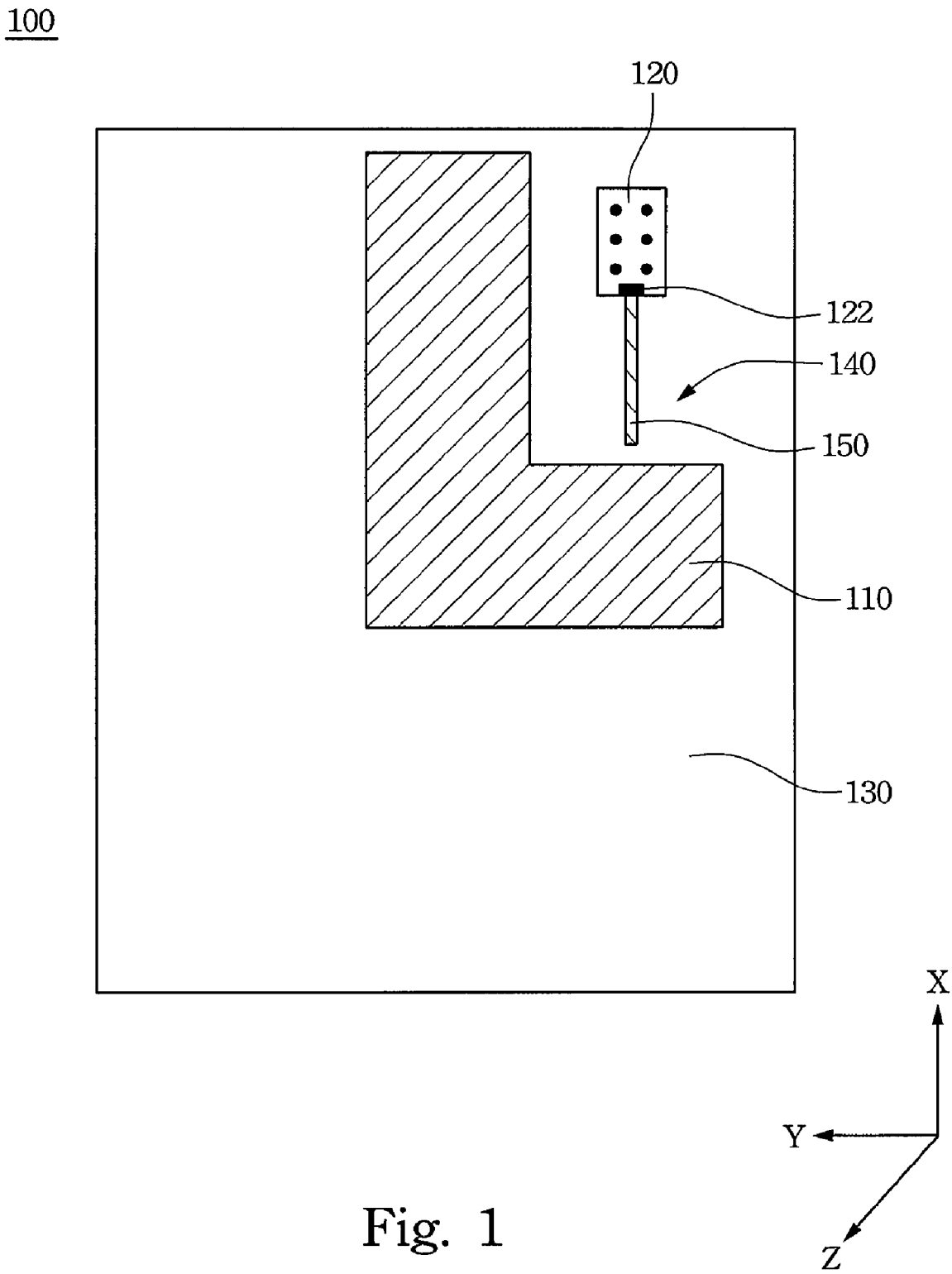
FIG. 1 is a schematic diagram illustrates one preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 illustrates a schematic diagram of a chip antenna apparatus 100 for receiving GPS signals of one preferred embodiment of the present invention. The chip antenna apparatus 100 for receiving GPS signals includes an L-shaped ground area 110 and an omni-directional chip antenna 120. The L-shaped ground area 110 is disposed on a circuit board 130. The omni-directional chip antenna 120 is disposed in a gap 140 of the L-shaped ground area 110 on the circuit board 130 and electrically connected to the L-shaped ground area 110.

The omni-directional chip antenna 120 of the chip antenna apparatus 100 is capable of receiving GPS signal in all angles so signal reception can be remarkably increased.

The omni-directional chip antenna 120 has a feed-in point 122 to transmit the signal from the feed-in point 122 to the circuit board 130. Generally, the feed-in point 122 may be a signal terminal of the chip antenna 120 or any part of the chip antenna 120 for signal transmission.

Refer to FIG. 1, the omni-directional chip antenna 120 is disposed in a gap 140 of the L-shaped ground area 110. In another word, the omni-directional chip antenna 120 is located on the upper-right corner of the cell phone. Further, two sides of the gap 140 of the L-shaped ground area 110 are extended to preferred lengths to cover the whole omni-directional chip antenna 120. In addition, the lengths of two sides of the gap 140 of the L-shaped ground area 110 may be equal or not equal to each other.

An electromagnetic coupling effect between the L-shaped ground area 110 and the omni-directional chip antenna 120 increases the circular polarization signal strength when the omni-directional chip antenna 120 receives GPS signal. In addition, there is a distance (the distance is greater than zero) between the L-shaped ground area 110 and the omni-directional chip antenna 120. In other word, there is an empty space around the omni-directional chip antenna 120 to prevent the L-shaped ground area 210 from affecting the reception of the omni-directional chip antenna 120.

Right-handed circular polarization (RHCP) is the signal used in GPS transmission nowadays. Hence, RHCP signal strength is increased by the appropriately dispose of the L-shaped ground area 110 and the omni-directional chip antenna 120 of the chip antenna apparatus 100.

Further, RHCP is changed to left-handed circular polarization (LHCP) because of ground reflection effect. The polarity of GPS signal is changed after ground reflection. Hence, the upper side of the chip antenna apparatus 100 receives RHCP signal and the lower side of the chip antenna apparatus 100 receives LHCP signal. Therefore, the signal reflected by the ground is also received by the omni-directional chip antenna 120.

Figure 2:
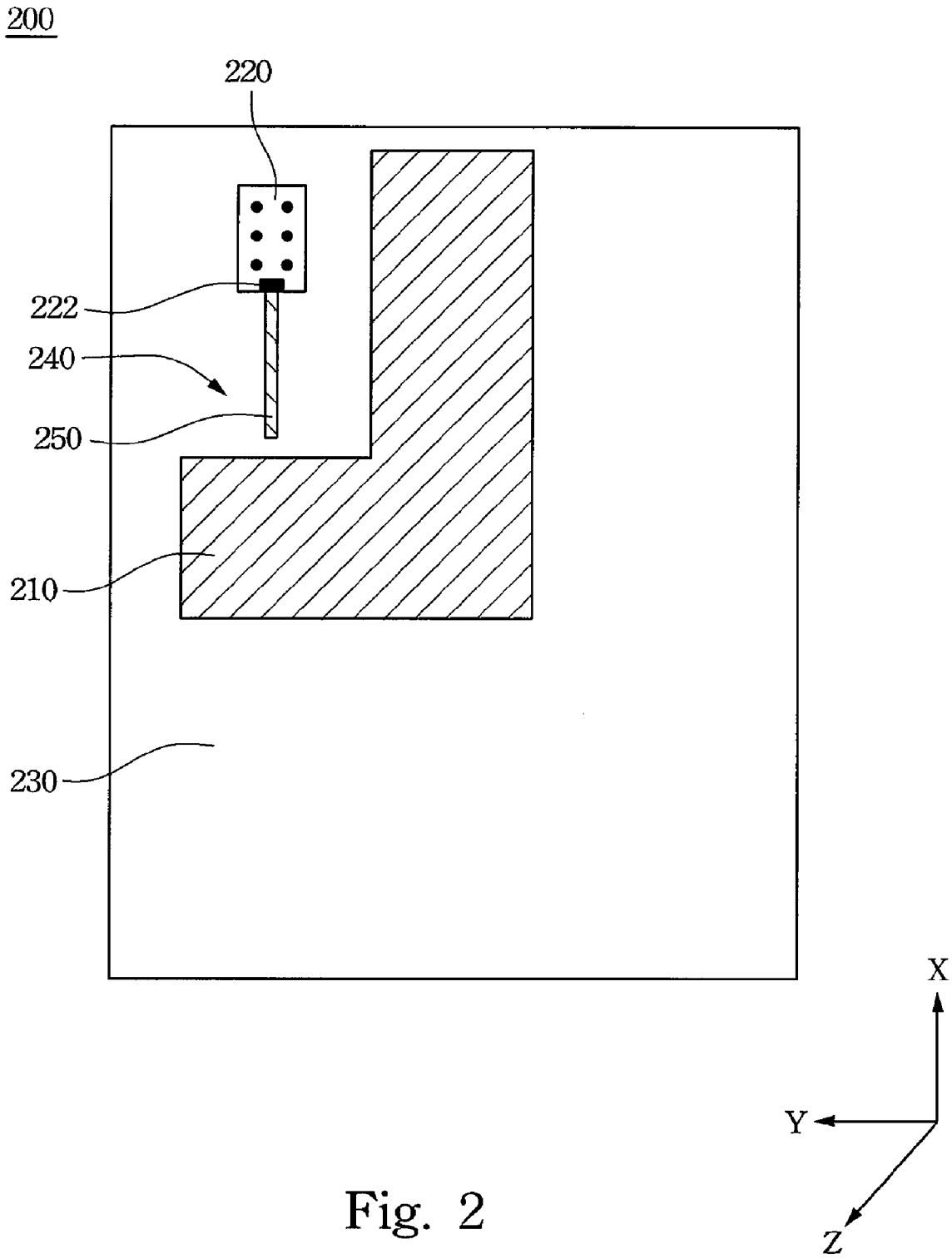
FIG. 2 is a schematic diagram illustrates another preferred embodiment of the present invention.

In addition, the L-shaped ground area can be inverted and disposed on the circuit board 230 according to another preferred embodiment of the present invention. FIG. 2 illustrates the chip antenna apparatus for receiving GPS signals of another preferred embodiment of the present invention.

Refer to FIG. 2, the chip antenna apparatus 200 for receiving GPS signals includes an L-shaped ground area 210 and an omni-directional chip antenna 220. The omni-directional chip antenna 220 is disposed in a gap 240 of the L-shaped ground area 210. The omni-directional chip antenna 220 is located on the upper-left corner of the cell phone and is capable of receiving GPS signals. Hence, any person skilled in the art to which it pertains can select the suitable omni-directional chip antenna 220, the L-shaped ground area 210 and the suitable place on the circuit board 230 to dispose the omni-directional chip antenna 220 and the L-shaped ground area 210 according to the requirement.

Besides, the L-shaped ground area 110, 210 is made of metal, alloy or other electrically conducting materials, for example, copper. The material of the base plate of the omni-directional chip antenna 120, 220 can be dielectric material (for example, FR4) and the wire can be metal, alloy or other electrically conducting materials (for example, copper).

Figure 3A:
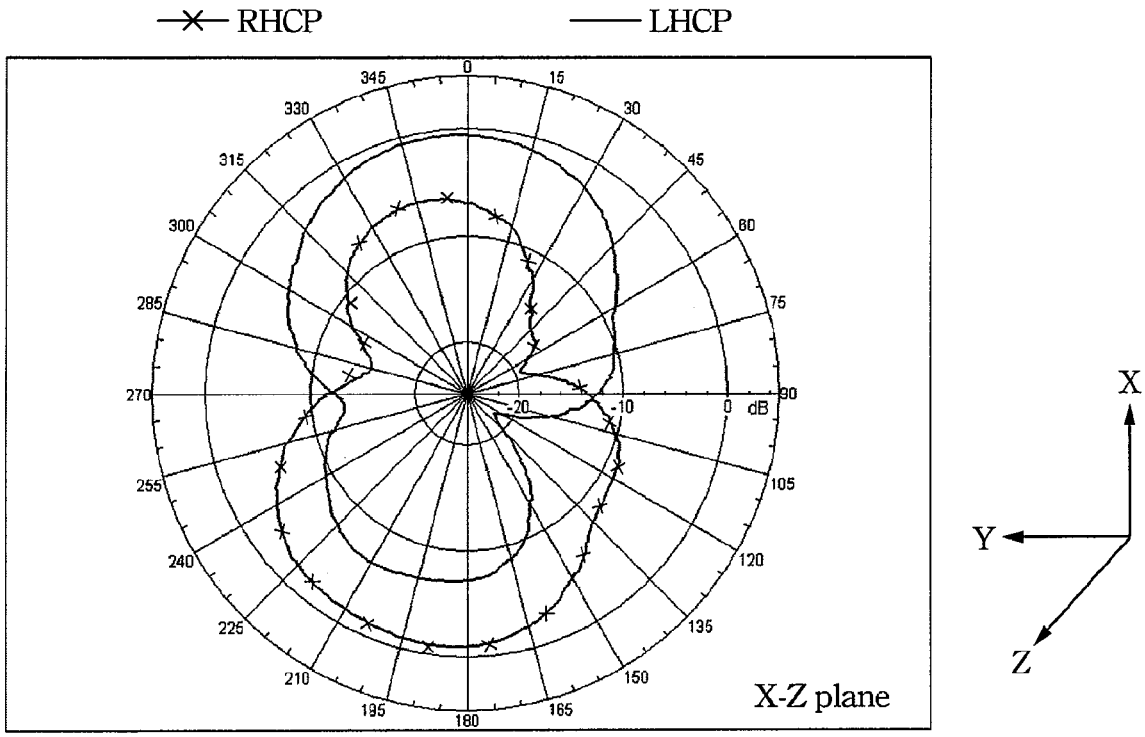
FIG. 3A is an antenna pattern of the omni-directional chip antenna of FIG. 1 on X-Z plane.
Figure 3B:
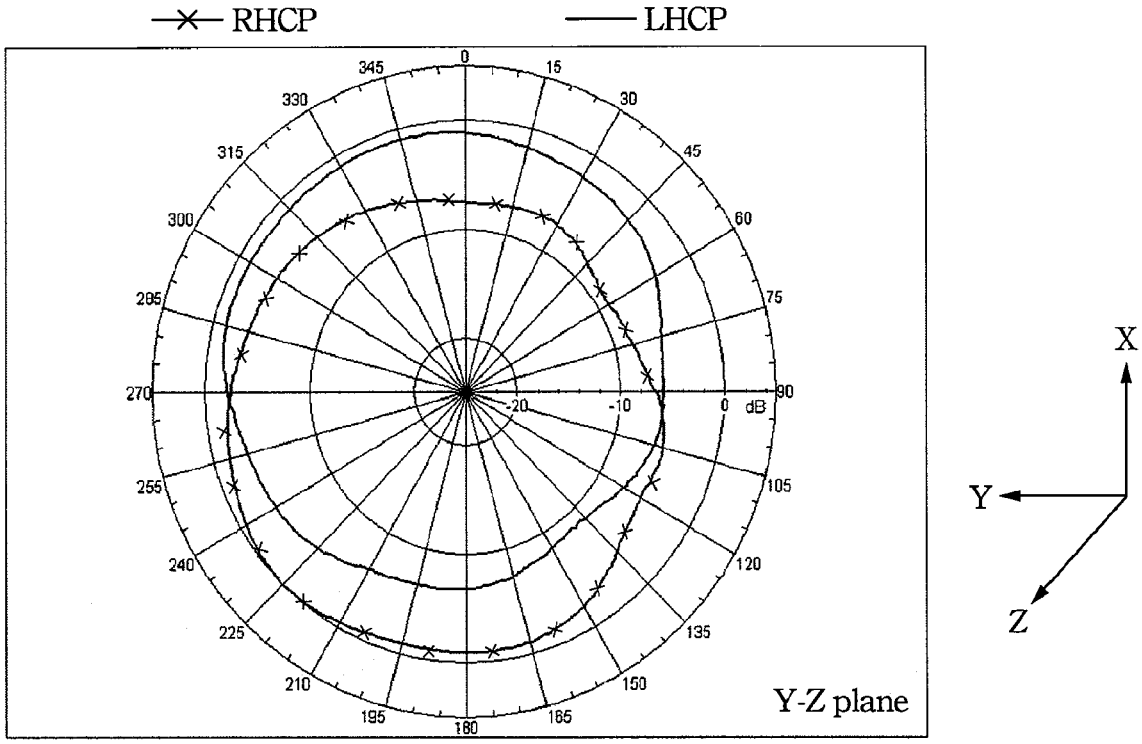
FIG. 3B is an antenna pattern of the omni-directional chip antenna of FIG. 1 on Y-Z plane.
Figure 4A:
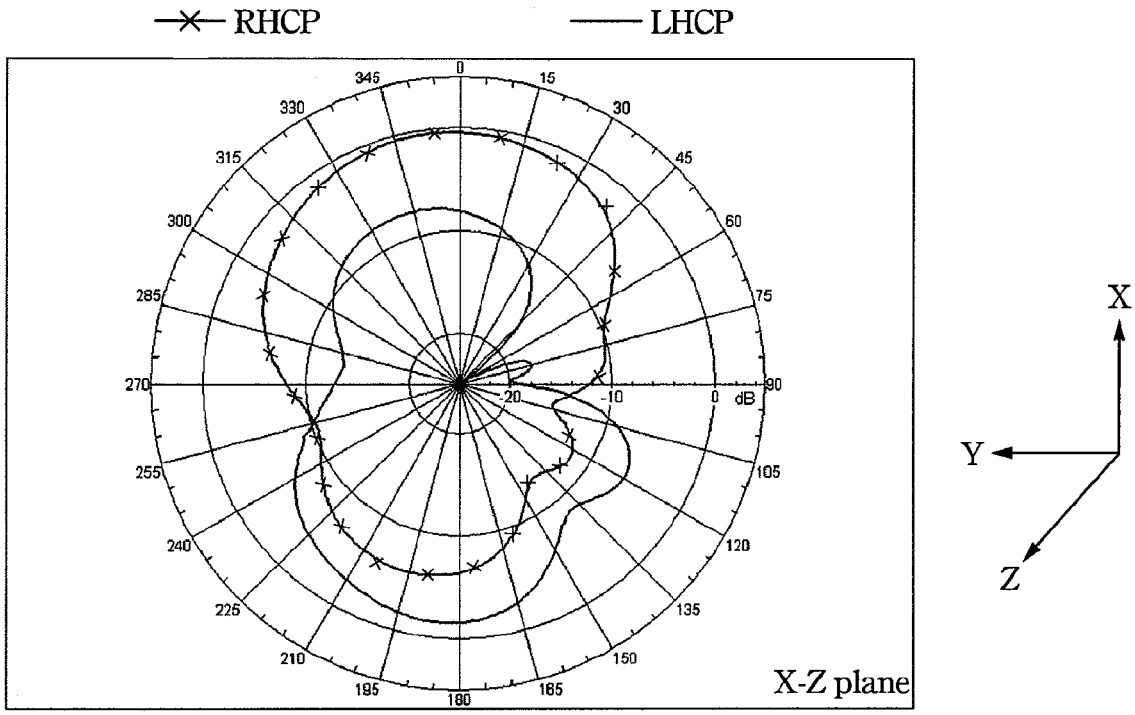
FIG. 4A is an antenna pattern of the omni-directional chip antenna of FIG. 2 on X-Z plane.
Figure 4B:
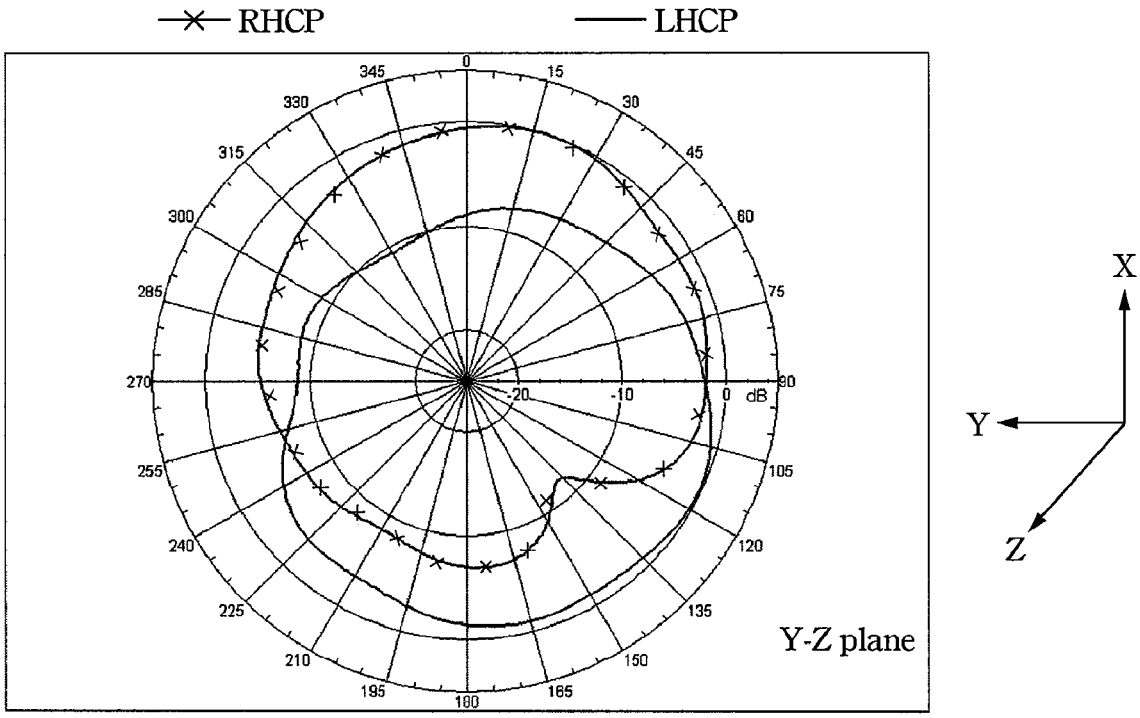
FIG. 4B is an antenna pattern of the omni-directional chip antenna of FIG. 2 on Y-Z plane.

FIG. 3A is an antenna pattern of the chip antenna apparatus 100 of FIG. 1 on X-Z plane and FIG. 3B is an antenna pattern of the chip antenna apparatus 100 of FIG. 1 on Y-Z plane. FIG. 4A is an antenna pattern of the chip antenna apparatus 200 of FIG. 2 on X-Z plane and FIG. 4B is an antenna pattern of the chip antenna apparatus 200 of FIG. 2 on Y-Z plane.

The foregoing antenna patterns illustrate the omni-directional chip antenna 120 and 220 having omni-directional functionality. In other words, cell phone integrates with the GPS functionality does not need to be pointed at any specific direction for better reception but receives GPS signal from all directions.

Figure 5:
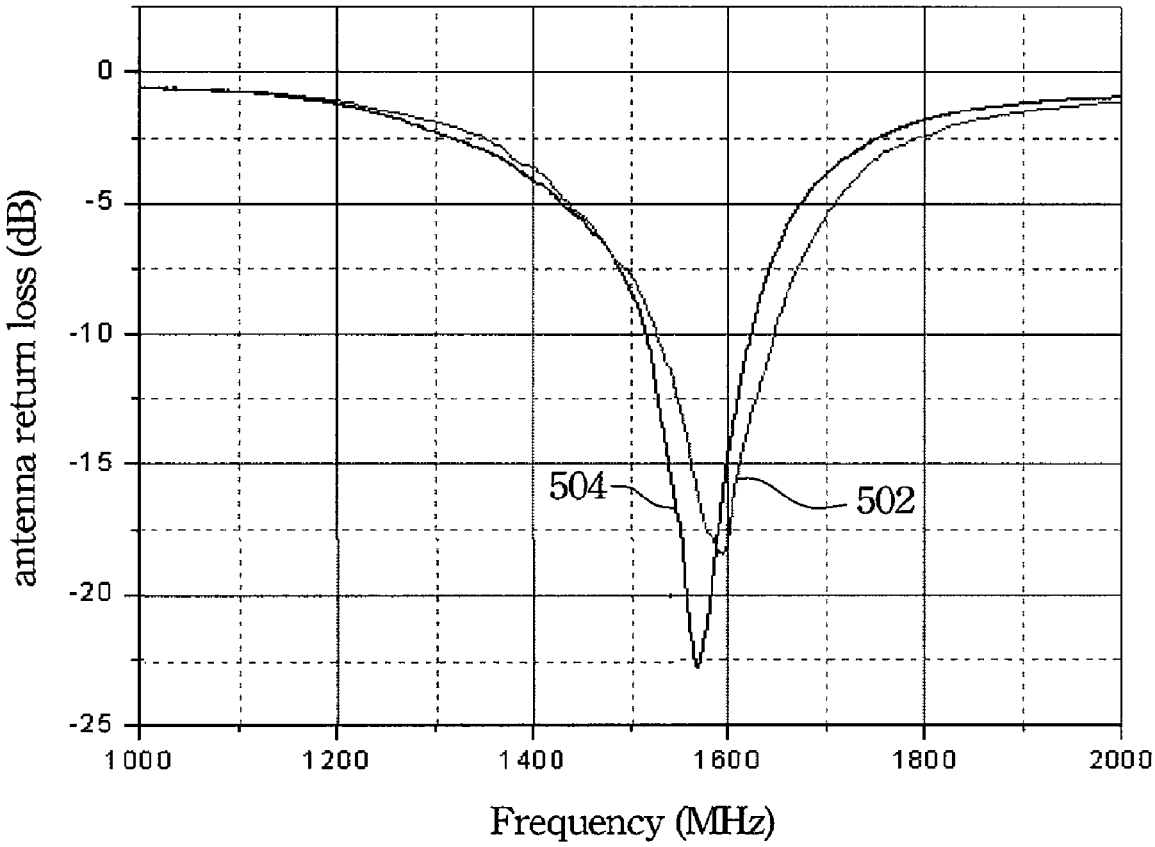
FIG. 5 is a graph of return loss versus frequency response illustrates the chip antenna apparatus of FIG. 1 and FIG. 2.

FIG. 5 is a graph of return loss versus frequency response illustrating the chip antenna apparatus 100 and 200. The vertical axis is return loss and the unit is dB and the horizontal axis is antenna frequency and the unit is MHz. Refer to FIG. 5, the frequency response curve 502 of the chip antenna apparatus 100 is different to the frequency response curve 504 of the chip antenna apparatus 200. In other words, the disposed positions of the omni-direction chip antenna and the L-shape ground area affect the frequency response of the antenna return loss.

Figure 6A:
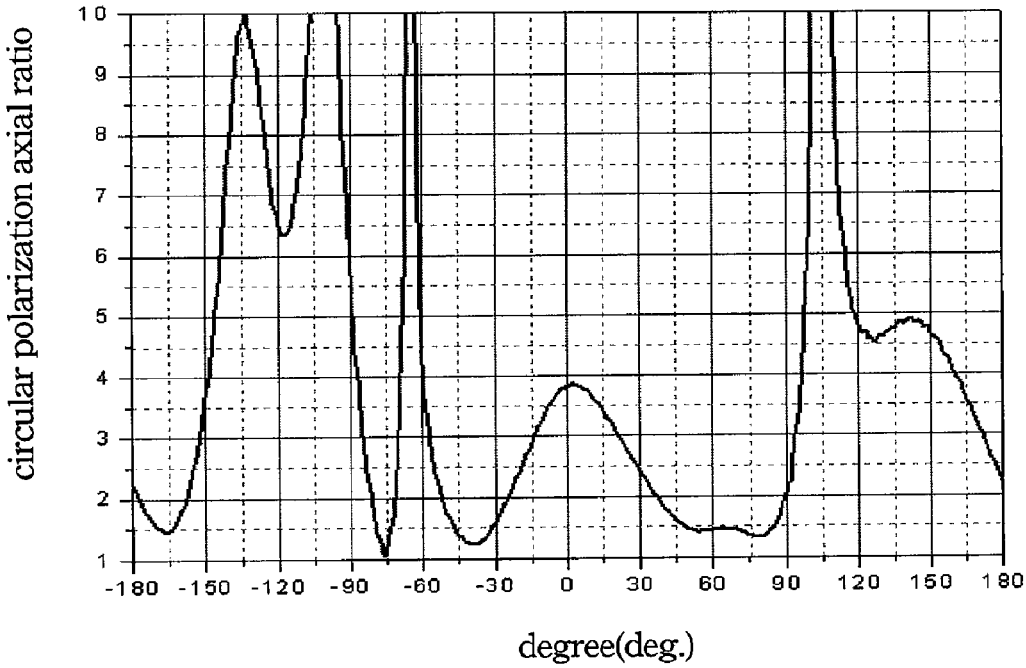
FIG. 6A is a circular polarization axial ratio graph illustrating the chip antenna apparatus of FIG. 1 on X-Z plane.
Figure 6B:
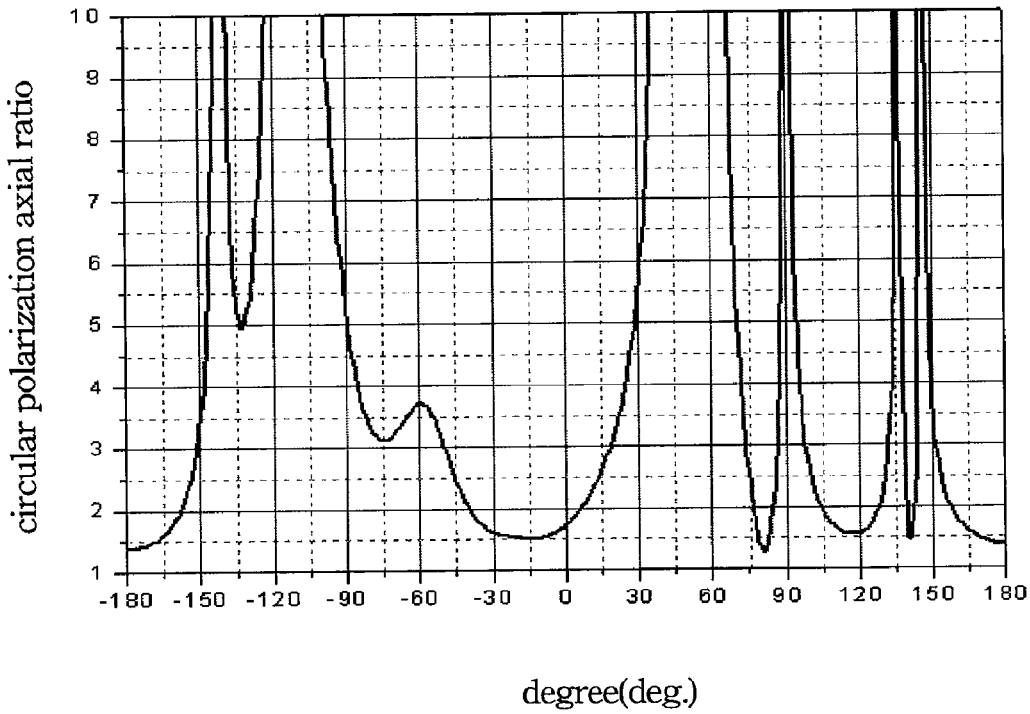
FIG. 6B is a circular polarization axial ratio graph illustrating the chip antenna apparatus of FIG. 1 on Y-Z plane.
Figure 7A:
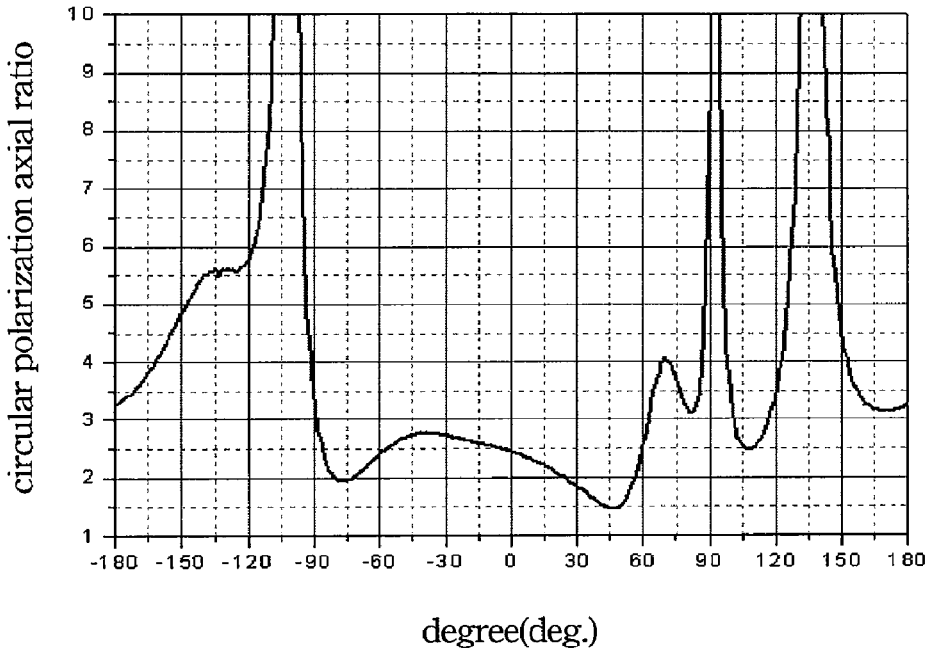
FIG. 7A is a circular polarization axial ratio graph illustrating the chip antenna apparatus of FIG. 2 on X-Z plane.
Figure 7B:
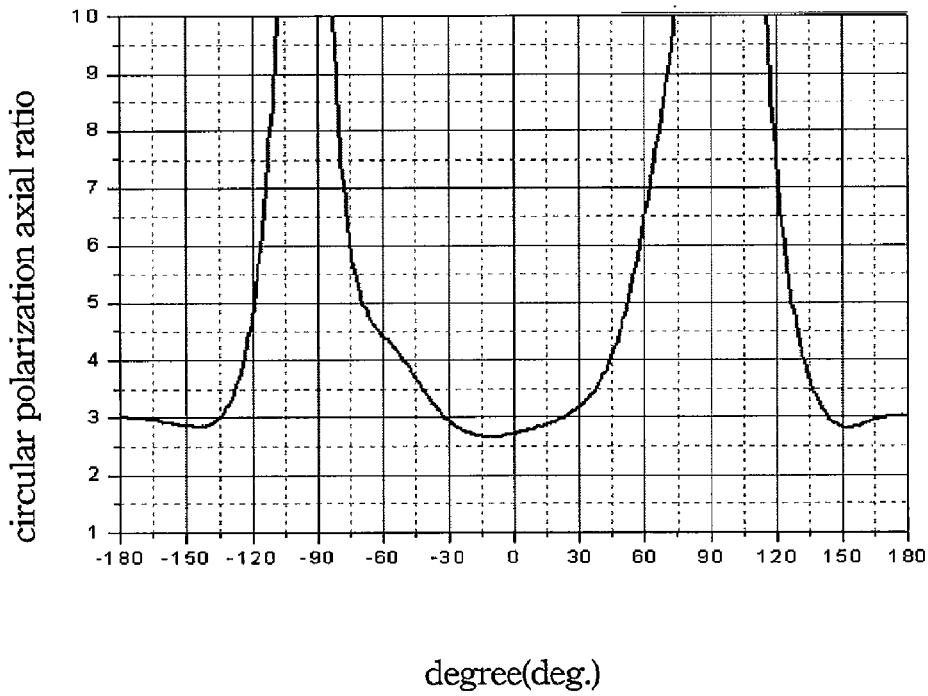
FIG. 7B is a circular polarization axial ratio graph illustrating the chip antenna apparatus of FIG. 2 on Y-Z plane.

FIG. 6A is a circular polarization axial ratio graph illustrating the chip antenna apparatus 100 on X-Z plane. FIG. 6B is a circular polarization axial ratio graph illustrating the chip antenna apparatus 100 on Y-Z plane. The vertical axis is circular polarization axial ratio and the horizontal axis is angle and the unit is degree. FIG. 7A is a circular polarization axial ratio graph illustrating the chip antenna apparatus 200 on X-Z plane. FIG. 7B is a circular polarization axial ratio graph illustrating the chip antenna apparatus 200 on Y-Z plane. The vertical axis is circular polarization axial ratio, and the horizontal axis is angle and the unit is degree.

The foregoing circular polarization axial ratio of chip antenna apparatus 100 and 200 shows the disposing method of the omni-directional chip antenna and the L-shaped ground area affects the characteristic of circular polarization of antenna pattern. Hence, the strength of directly received and reflected signal can be increased by choosing appropriate positions for the omni-directional chip antenna and the L-shaped ground area The size of the gap of the L-shaped ground area is described below. The size of the empty space around the chip antenna can also affect the characteristic of circular polarization, frequency response of the antenna return loss and antenna pattern of the chip antenna apparatus. Further, the size of the ground area can also affect the characteristic of circular polarization, frequency response of the antenna return loss and antenna pattern of the chip antenna apparatus.

Figure 8:
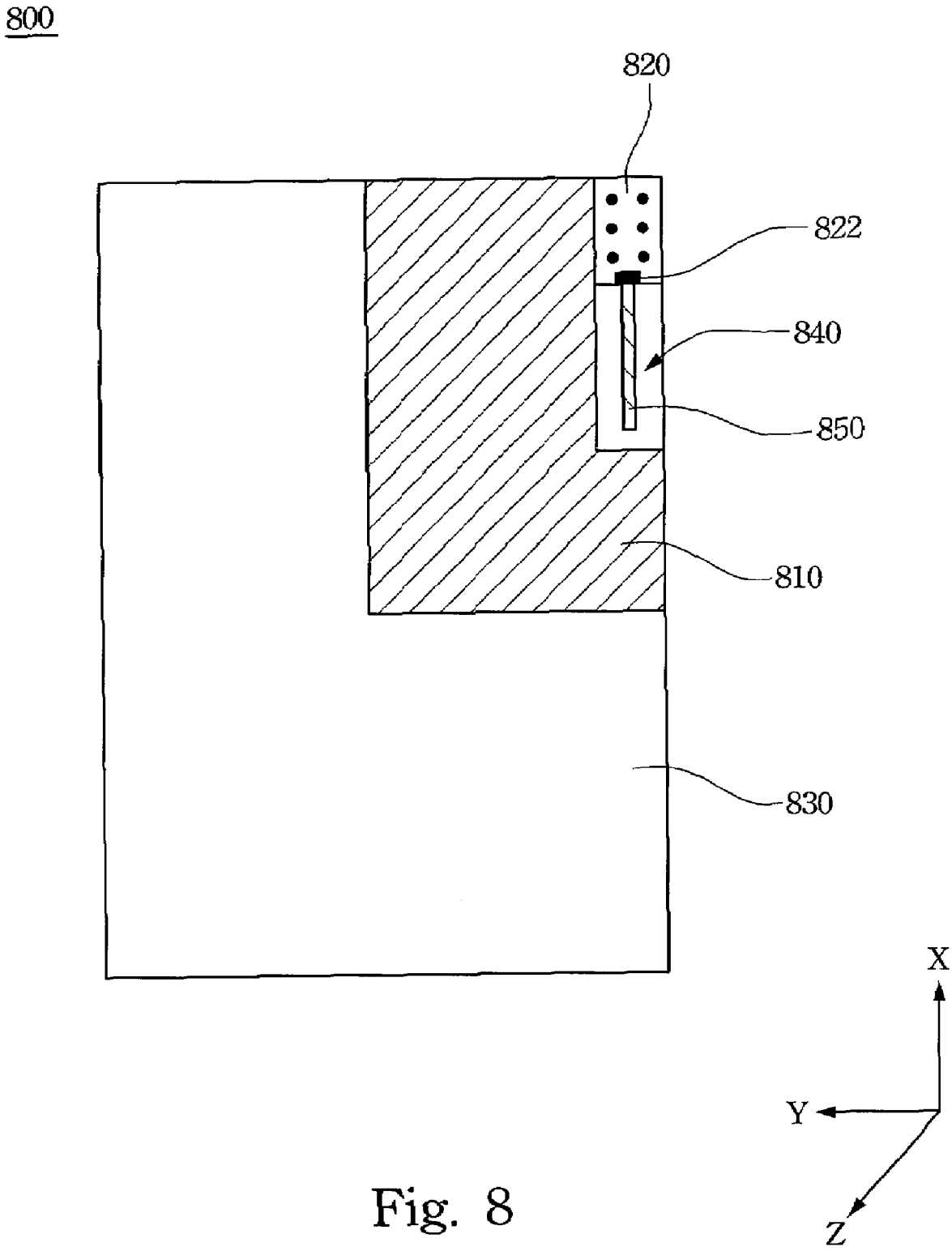
FIG. 8 is a schematic diagram illustrating another preferred embodiment of the present invention.

FIG. 8 is a schematic diagram illustrating a chip antenna apparatus for receiving the GPS signal of another preferred embodiment of the present invention. The chip antenna apparatus 800 for receiving GPS signals includes an L-shaped ground area 810 and an omni-directional chip antenna 820. The L-shaped ground area 810 is disposed on a circuit board 830. The omni-directional chip antenna 820 is disposed in a gap 840 of the L-shaped ground area 810 on the circuit board 830 and electrically connected to the L-shaped ground area 810.

The omni-directional chip antenna 820 has a feed-in point 822 to transmit signal from the feed-in point 822 to the circuit board 830. Generally, the feed-in point 822 may be a signal terminal of the chip antenna 820 or any part of the chip antenna 820 for signal transmission.

Refer to FIG. 8, the omni-directional chip antenna 820 is located on the upper-right corner of the cell phone. Further, two sides of the gap 840 of the L-shaped ground area 810 is extended to preferred lengths to cover the whole omni-directional chip antenna 820. In addition, the lengths of the two sides of the gap 840 of the L-shaped ground area 810 may be equal or not equal to each other. The electromagnetic coupling effect between the L-shaped ground area 810 and the omni-directional chip antenna 820 increases the circular polarization signal strength when the omni-directional chip antenna 820 receives GPS signal. In addition, the distance between the L-shaped ground area 810 and the omni-directional chip antenna 820 is zero.

Right-handed circular polarization (RHCP) is the signal used in GPS transmission nowadays. Hence, RHCP signal strength is increased by appropriately dispose of the L-shaped ground area 810 and the omni-directional chip antenna 820 of the chip antenna apparatus 800.

Further, RHCP is changed to the left-handed circular polarization (LHCP) because of ground reflection. The polarity of GPS signal is changed after ground reflection. Hence, the upper side of the chip antenna apparatus 800 receives RHCP signal and the lower side of the chip antenna apparatus 800 receives LHCP signal. Therefore, the signal reflected by the ground is also received by the omni-directional chip antenna 820.

Figure 9:
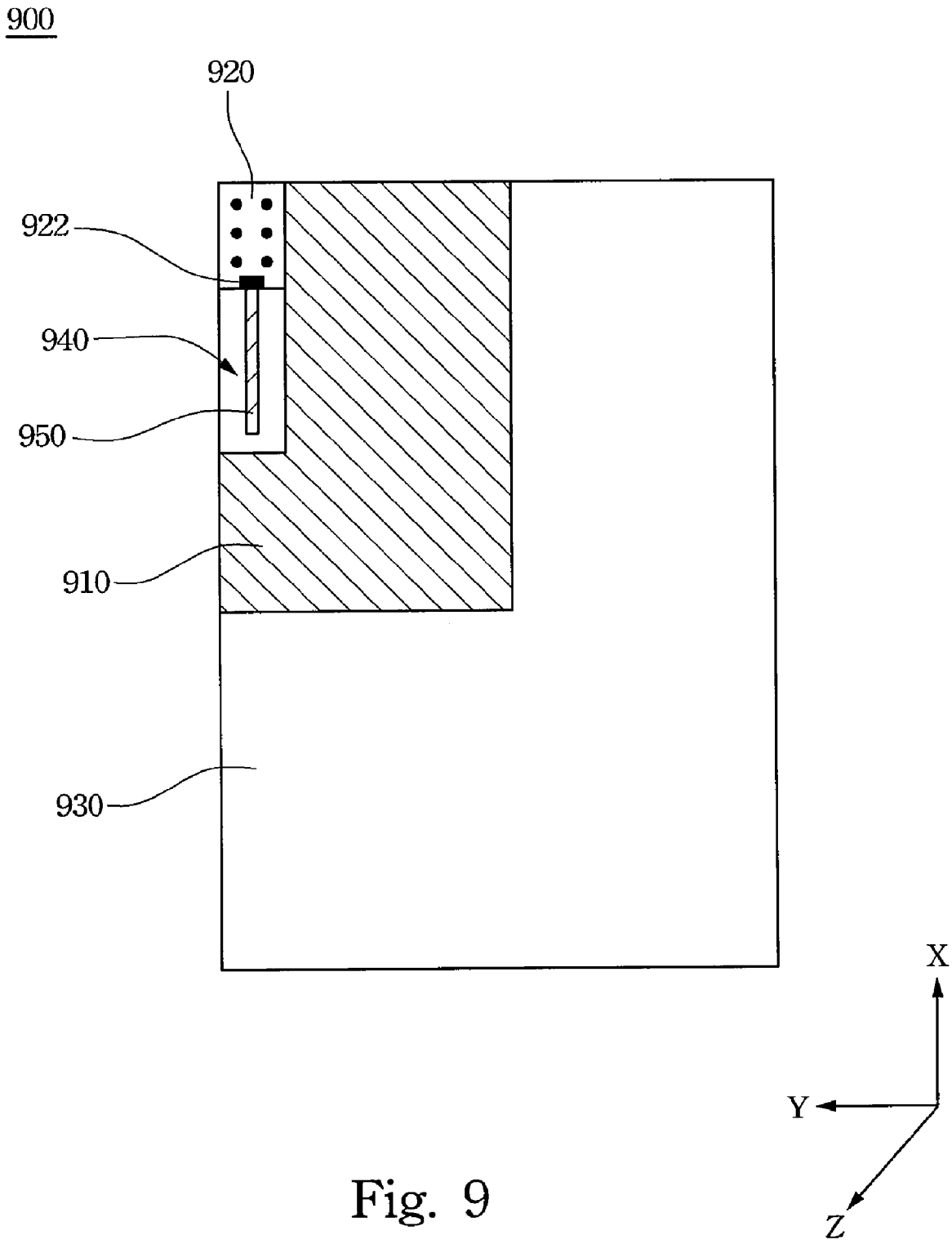
FIG. 9 is a schematic diagram illustrating another preferred embodiment of the present invention.

In addition, the L-shaped ground area can be inverted and disposed on the circuit board 930 according to another preferred embodiment of the present invention. FIG. 9 illustrates the chip antenna apparatus for receiving GPS signals of another preferred embodiment of the present invention.

Refer to FIG. 9, the chip antenna apparatus 900 for receiving GPS signals includes an L-shaped ground area 910 and an omni-directional chip antenna 920. The omni-directional chip antenna 920 is disposed in a gap 940 of the L-shaped ground area 910. The omni-directional chip antenna 920 is located on the upper-left corner of the cell phone, and is capable of receiving GPS signals. Hence, any person skilled in the art to which it pertains can select the suitable omni-directional chip antenna 920, the L-shaped ground area 910 and the suitable place to dispose the omni-directional chip antenna 920 and the L-shaped ground area 910 according to the requirement.

Besides, the L-shaped ground area 810, 910 is made of metal, alloy or other electrically conducting materials, for example, copper. The material of the base plate of the omni-directional chip antenna 820, 920 can be dielectric material (for example, FR4) and the wire can be metal, alloy or other electrically conducting material (for example, copper).

Figure 10A:
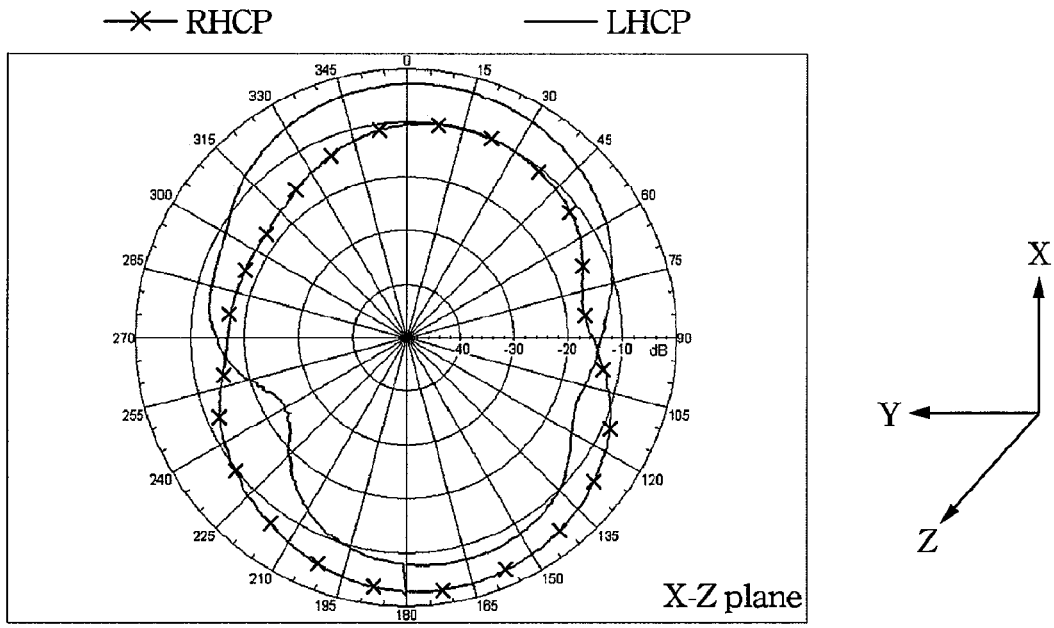
FIG. 10A is an antenna pattern of the omni-directional chip antenna of FIG. 8 on X-Z plane.
Figure 10B:
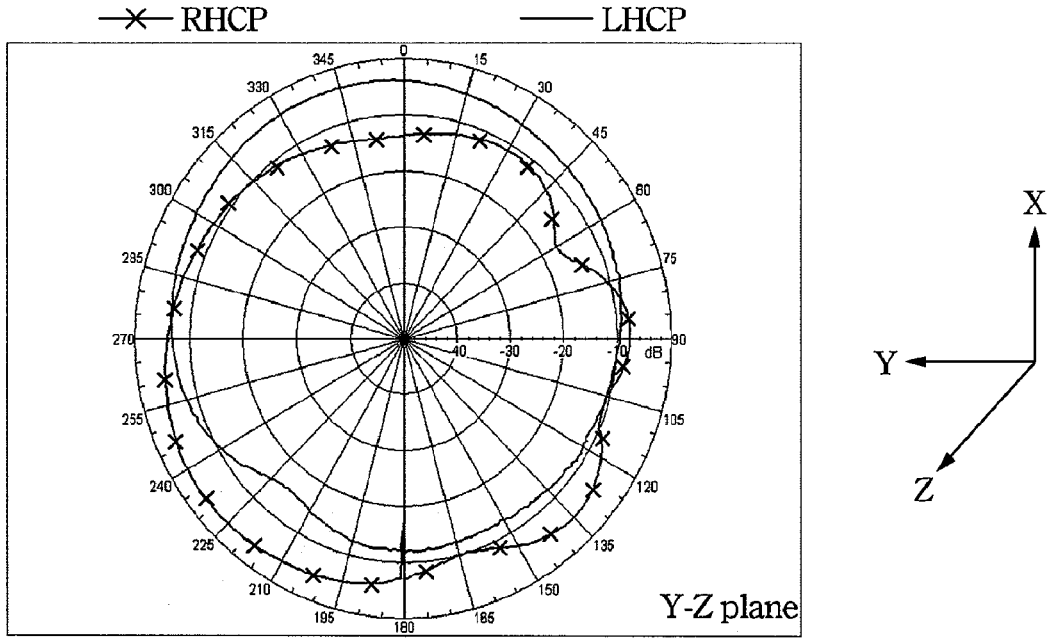
FIG. 10B is an antenna pattern of the omni-directional chip antenna of FIG. 8 on Y-Z plane.
Figure 11A:
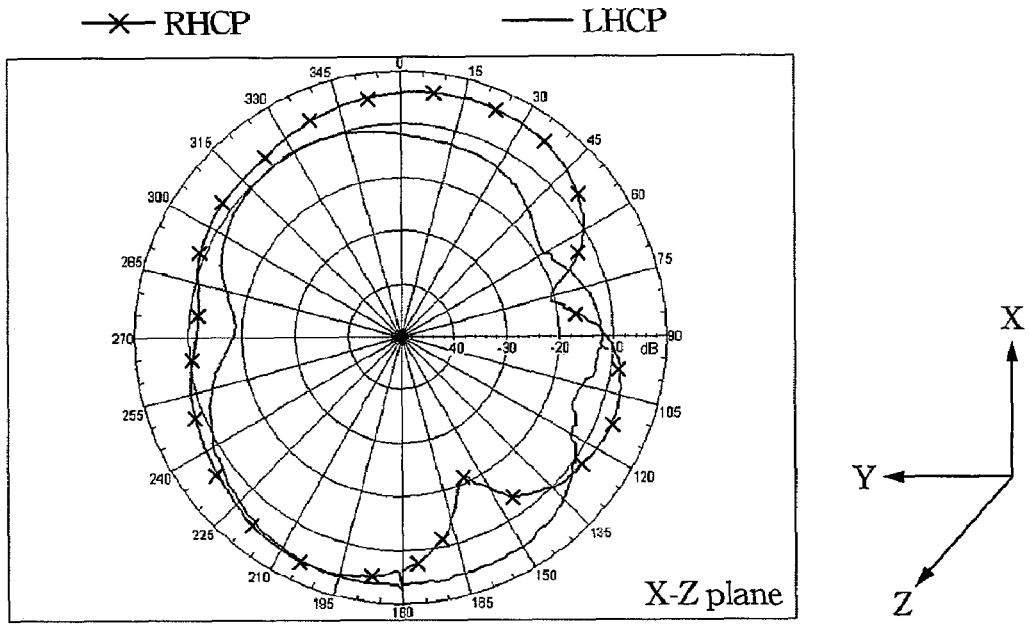
FIG. 11A is an antenna pattern of the omni-directional chip antenna of FIG. 9 on X-Z plane.
Figure 11B:
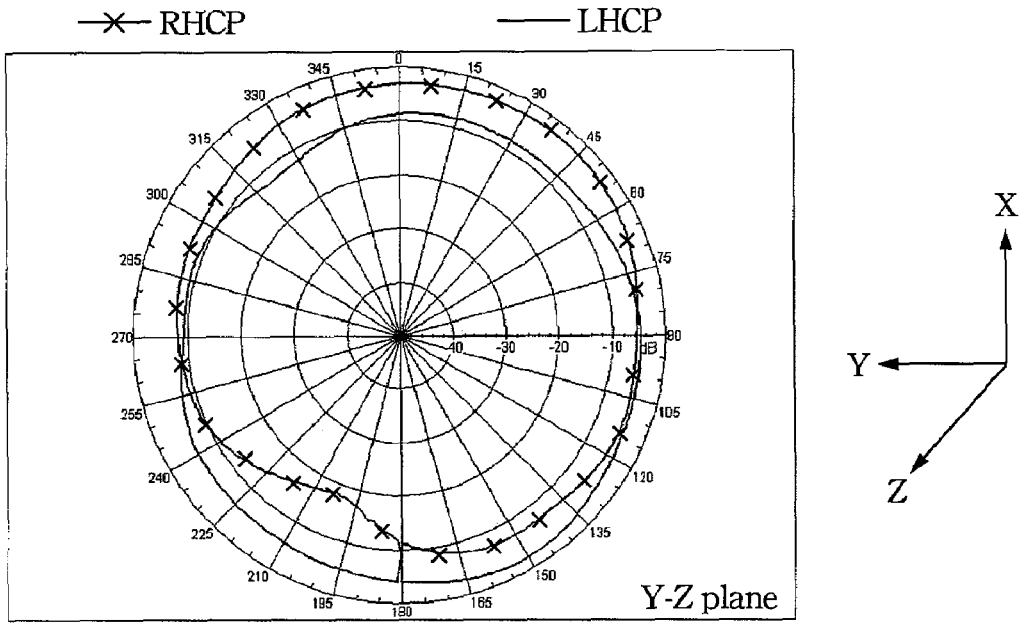
FIG. 11B is an antenna pattern of the omni-directional chip antenna of FIG. 9 on Y-Z plane.

FIG. 10A is an antenna pattern of the chip antenna apparatus 800 of FIG. 8 on X-Z plane and FIG. 10B is an antenna pattern of the chip antenna apparatus 800 of FIG. 8 on Y-Z plane. FIG. 11A is an antenna pattern of the chip antenna apparatus 900 of FIG. 9 on X-Z plane and FIG. 11B is an antenna pattern of the chip antenna apparatus 900 of FIG. 9 on Y-Z plane.

The foregoing antenna patterns illustrate the omni-directional chip antenna 820 and 920 having omni-directional functionality. In other words, cell phone integrates with GPS functionality does not need to be pointed at any specific direction for better reception but receives GPS signal from all directions.

Figure 12:
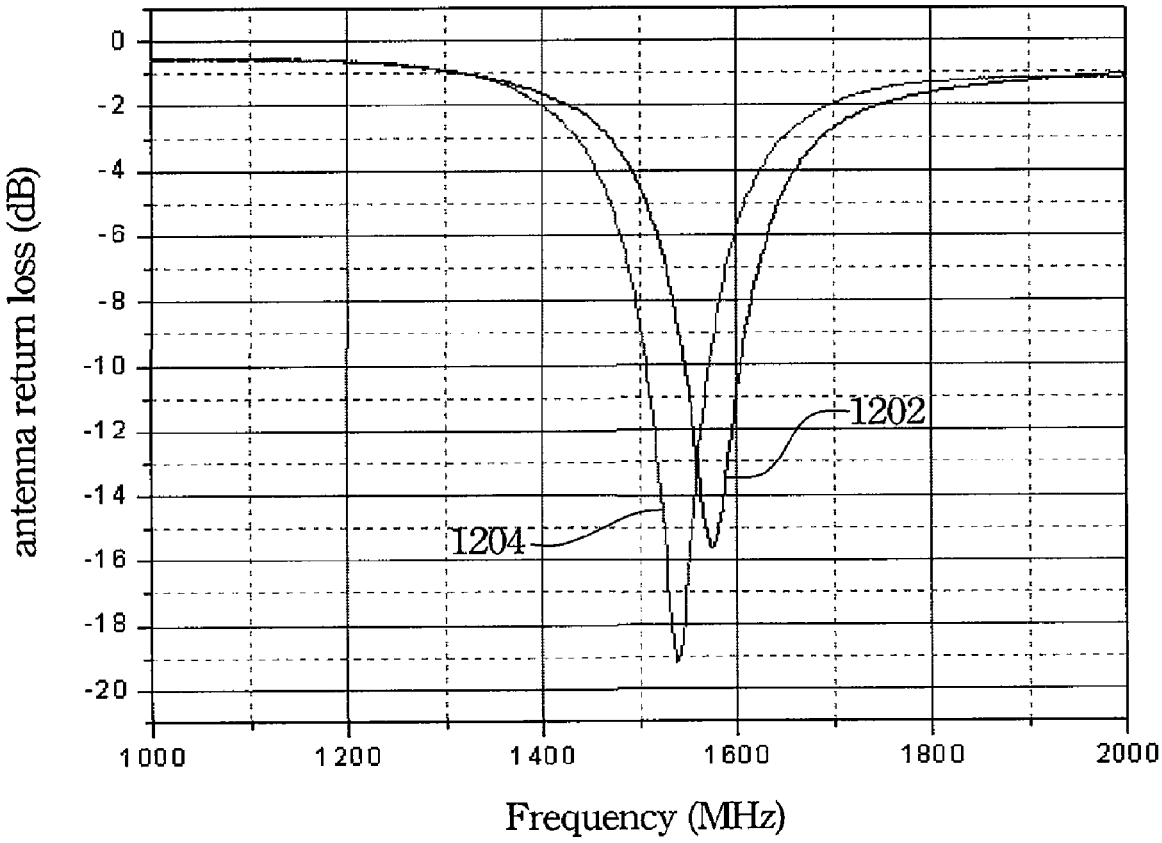
FIG. 12 is a graph of return loss versus frequency response illustrating the chip antenna apparatus of FIG. 8 and FIG. 9.

FIG. 12 is a graph of return loss versus frequency response illustrating the chip antenna apparatus 800 and 900. The vertical axis is return loss and the unit is dB and the horizontal axis is antenna frequency and the unit is MHz. Refer to FIG. 12, the frequency response curve 1202 of the chip antenna apparatus 800 is different to the frequency response curve 1204 of the chip antenna apparatus 900. In other words, the disposed positions of the omni-direction chip antenna and the L-shape ground area affect frequency response of the antenna return loss.

Figure 13A:
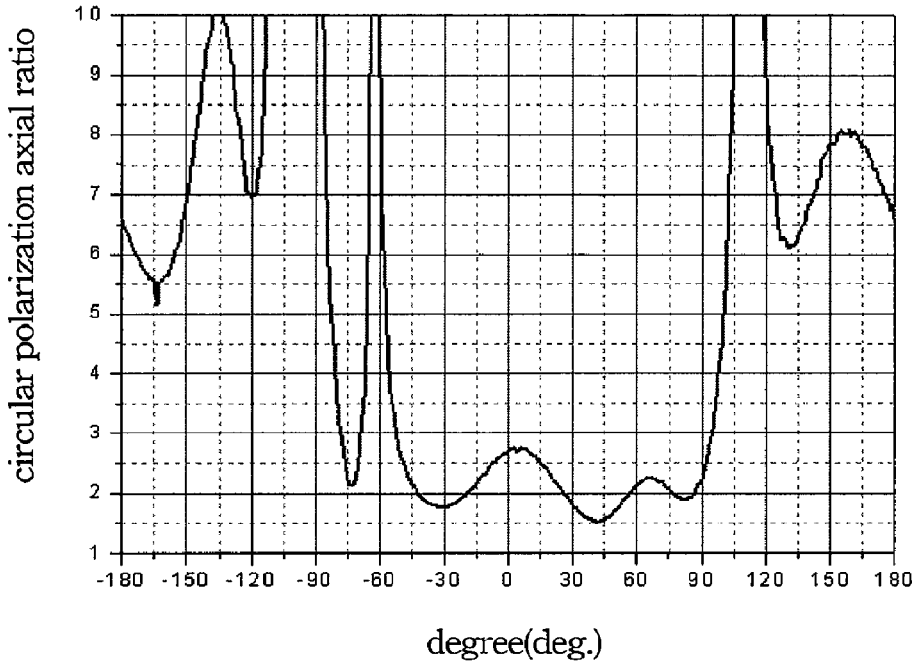
FIG. 13A is a circular polarization axial ratio graph illustrating the chip antenna apparatus of FIG. 8 on X-Z plane.
Figure 13B:
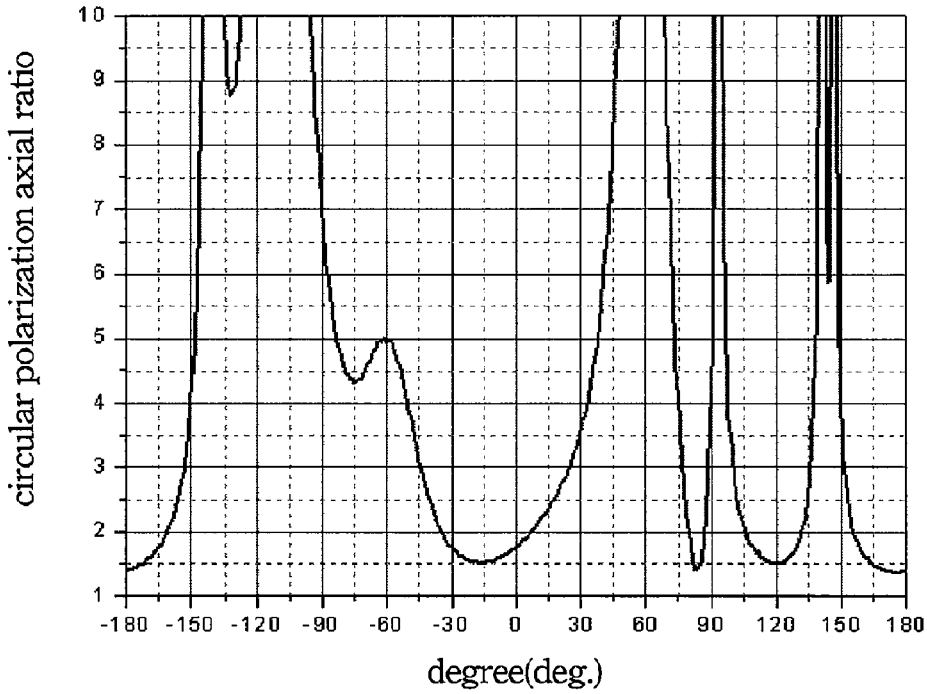
FIG. 13B is a circular polarization axial ratio graph illustrating the chip antenna apparatus of FIG. 8 on Y-Z plane.
Figure 14A:
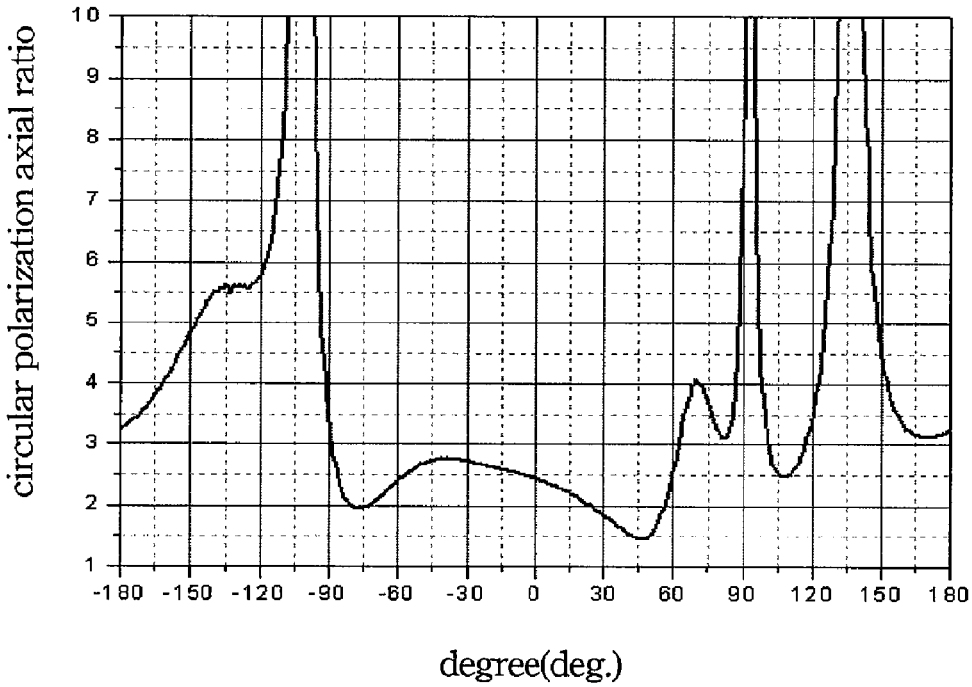
FIG. 14A is a circular polarization axial ratio graph illustrating the chip antenna apparatus of FIG. 9 on X-Z plane.
Figure 14B:
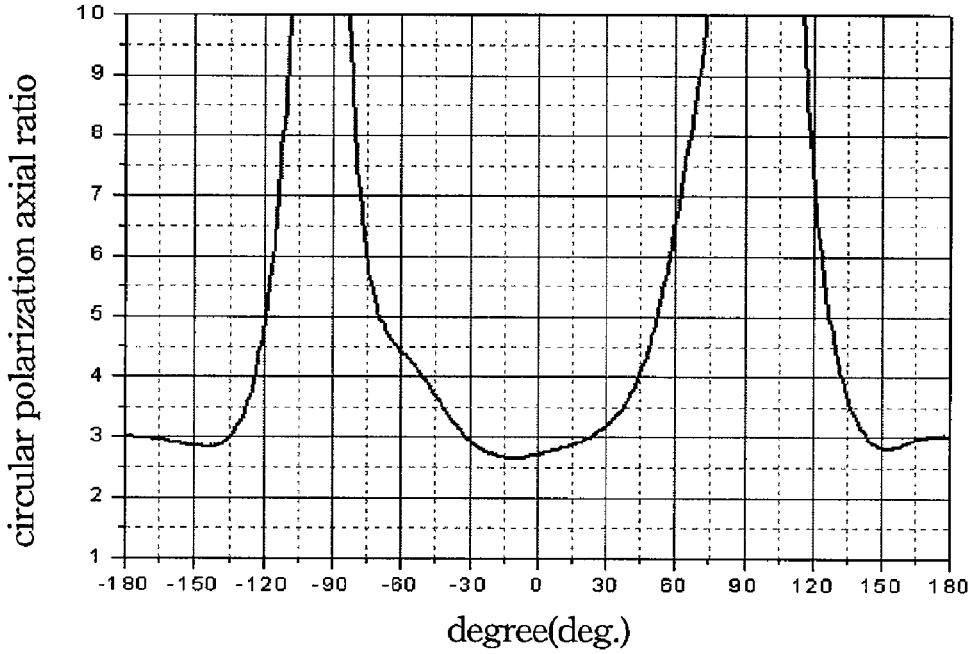
FIG. 14B is a circular polarization axial ratio graph illustrating the chip antenna apparatus of FIG. 9 on Y-Z plane.

FIG. 13A is a circular polarization axial ratio graph illustrating the chip antenna apparatus 800 on X-Z plane. FIG. 13B is a circular polarization axial ratio graph illustrating the chip antenna apparatus 800 on Y-Z plane. The vertical axis is circular polarization axial ratio and the horizontal axis is angle and the unit is degree. FIG. 14A is a circular polarization axial ratio graph illustrating the chip antenna apparatus 900 on X-Z plane. FIG. 14B is a circular polarization axial ratio graph illustrating the chip antenna apparatus 900 on Y-Z plane. The vertical axis is circular polarization axial ratio and the horizontal axis is angle and the unit is degree.

The foregoing circular polarization axial ratio of chip antenna apparatus 800 and 900 shows the disposing method of the omni-directional chip antenna and the L-shaped ground area affects the characteristic of circular polarization of antenna pattern. Hence, the strength of directly received and reflected signal can be increased by choosing appropriate positions for the omni-directional chip antenna and the L-shaped ground area.

The preferred embodiments of the present invention described above shows: the present invention provides a chip antenna apparatus for receiving GPS signals. The chip antenna apparatus for receiving the GPS signal uses an omni-directional chip antenna to receive the omni-directional GPS signals. In other aspect, the omni-directional chip antenna is disposed in a gap of an L-shaped ground area. An electromagnetic coupling effect between the omni-directional chip antenna and the L-shaped ground area increases circular polarization signal strength, so the positioning precision of the chip antenna apparatus can be enhanced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chip antenna apparatus for receiving Global Positioning System signals, comprising:

an L-shaped ground area, disposed on a circuit board; and an omni-directional chip antenna, disposed in a gap of the L-shaped ground area, is located in an upper-right corner of the circuit board and electrically connected to the L-shaped ground area, wherein the omni-directional chip antenna receives right-handed circular polarization signals, and wherein there is a distance between the L-shaped ground area and the omni-directional chip antenna.

2. The chip antenna apparatus for receiving Global Positioning System signals of claim 1, wherein the omni-directional chip antenna has a feed-in point, the circuit board receives the signal from the omni-directional chip antenna via the feed-in point.

3. The chip antenna apparatus for receiving Global Positioning System signals of claim 1, wherein the L-shaped ground area is made of metal, alloy or other conducting materials.

* * * * *